US011578439B2

(12) United States Patent
Weigert et al.

(10) Patent No.: US 11,578,439 B2
(45) Date of Patent: Feb. 14, 2023

(54) METHOD OF MANUFACTURING A WET-LAID NONWOVEN FABRIC

(71) Applicants: VOITH PATENT GMBH, Heidenheim (DE); TRUETZSCHLER GMBH & CO.KG, Moenchengladbach (DE)

(72) Inventors: Thomas Weigert, Sulzbach (DE); Kai Poehler, Vettweis (DE); Ralf Schroeder, Juelich (DE)

(73) Assignees: Voith Patent GmbH, Heidenheim (DE); Truetzschler GmbH & Co. KG, Moenchengladbach (DE)

( * ) Notice: Subject to any disclaimer, the term of this patent is extended or adjusted under 35 U.S.C. 154(b) by 627 days.

(21) Appl. No.: 16/331,553

(22) PCT Filed: Sep. 11, 2017

(86) PCT No.: PCT/EP2017/072715
§ 371 (c)(1),
(2) Date: Mar. 8, 2019

(87) PCT Pub. No.: WO2018/050588
PCT Pub. Date: Mar. 22, 2018

(65) Prior Publication Data

US 2019/0249346 A1 Aug. 15, 2019

(30) Foreign Application Priority Data

Sep. 14, 2016 (DE) ..... 102016217481.9

(51) Int. Cl.
*D04H 1/492* (2012.01)
*D04H 1/485* (2012.01)
(Continued)

(52) U.S. Cl.
CPC ..... *D04H 1/492* (2013.01); *D04H 1/485* (2013.01); *D04H 1/732* (2013.01); *D04H 18/04* (2013.01)

(58) Field of Classification Search
CPC ..... D04H 1/498; D04H 1/492; D04H 1/52; D04H 1/06; D04H 1/665; D04H 18/04
See application file for complete search history.

(56) References Cited

U.S. PATENT DOCUMENTS 4,693,913 A * 9/1987 Gessner ..... B29B 15/127 427/215
4,775,579 A * 10/1988 Hagy ..... B32B 5/04 442/329

(Continued)

FOREIGN PATENT DOCUMENTS

DE 69936962 T2 5/2008
DE 102014107725 A1 12/2015

(Continued)

*Primary Examiner* — Jillian K Pierorazio
(74) *Attorney, Agent, or Firm* — Laurence A. Greenberg; Werner H. Stemer; Ralph E. Locher

(57) ABSTRACT

A method of manufacturing a wet-laid nonwoven web includes the following steps: feeding a pulp suspension onto a forming screen for depositing a fibrous web thereon, wherein the pulp suspension has industrially produced, inorganic fibers or fibers of synthetically produced polymers and the pulp suspension is substantially free from binders, such as chemical binders, and hydraulic consolidation of the fibrous web to generate the nonwoven web through water jet needling of the fibrous web.

15 Claims, 1 Drawing Sheet

(51) Int. Cl.
*D04H 1/732* (2012.01)
*D04H 18/04* (2012.01)

(56) References Cited

U.S. PATENT DOCUMENTS

| | | | | |
|---|---|---|---|---|
| 5,334,446 | A * | 8/1994 | Quantrille | B32B 7/12 442/35 |
| 5,393,599 | A * | 2/1995 | Quantrille | B32B 5/26 442/57 |
| 6,110,848 | A | 8/2000 | Bouchette | |
| 2007/0087642 | A1* | 4/2007 | Bridgeman | D04H 1/43835 442/302 |
| 2010/0048072 | A1* | 2/2010 | Kauschke | A47L 13/16 442/1 |
| 2010/0173552 | A1* | 7/2010 | Fernando | C04B 35/6316 442/414 |
| 2011/0126499 | A1* | 6/2011 | Kumar | B32B 1/08 55/495 |
| 2011/0201243 | A1* | 8/2011 | Miele | D04H 1/488 442/331 |
| 2013/0199744 | A1* | 8/2013 | Shimada | D04H 1/72 162/157.3 |
| 2013/0232712 | A1* | 9/2013 | Kawai | D04H 1/558 15/209.1 |
| 2017/0233909 | A1* | 8/2017 | Wright | B32B 5/06 428/172 |
| 2017/0306562 | A1* | 10/2017 | Phipps | D01F 2/00 |

FOREIGN PATENT DOCUMENTS

| | | | |
|---|---|---|---|
| EP | 2634297 | A1 | 9/2013 |
| WO | 02059411 | A2 | 8/2002 |
| WO | 2015000685 | A1 | 1/2015 |

* cited by examiner

METHOD OF MANUFACTURING A WET-LAID NONWOVEN FABRIC

BACKGROUND OF THE INVENTION

Field of the Invention

The invention relates to a method of manufacturing a wet-laid nonwoven fabric.

Known methods of manufacturing of nonwoven fabrics from natural fibers such as cellulose fibers usually comprise forming a fibrous web and subsequent dewatering, such as drying. Different methods for such web formation are known from the prior art. The fibrous web is typically formed through a wet-laying process on an inclined wire former, with the pulp suspension having a very low consistency, and in particular having a solids content of 0.01 to 0.1 wt % relative to 100 wt % of the obtained nonwoven fabric.

Natural fibers typically form hydrogen bonds with each other as soon as they are added to water. This allows nonwoven webs of natural fibers to be manufactured without the use of binders in the pulp suspension. Such bonds do not arise with artificial fibers, such as fibers of synthetically produced polymers, and especially with industrially-produced inorganic fibers. Accordingly, heretofore it has been necessary to resort to corresponding chemical binders or thermal binder fibers to bind such fibers with each other and thus to obtain a viable nonwoven fabric in the wet-laying process. First, chemical binders of this sort could be added to the pulp suspension as chemical reagents. Second, wet-laid nonwoven webs could subsequently be soaked with such a binder in a binder section. Both methods have the drawback that a certain quantity of chemical additives is necessary; these additives may be problematic to store, handle and dispose of. When the nonwoven web is impregnated by means of the binder section, contamination occurs as a result of encrusting by the binders, which, unless promptly removed, entail high cleaning costs. As an alternative to the chemical consolidation methods, in thermal consolidation methods, binder fibers in the form of thermoplastics are added to the conventional fibers of the pulp suspension. These are melted in a later method step, at which point they surround the fibers and stick to them after cooling.

However, the previous chemical and thermal consolidation processes have the drawback that the binders or binder fibers that are used are not suitable for high-temperature applications above, for example, 300° C.

SUMMARY OF THE INVENTION

The present invention relates to the aforementioned general subject matter.

The objective of the present invention is to provide a method and an apparatus of the type mentioned above, by means of which the aforementioned problems are eliminated in the simplest and most reliable manner possible. In particular, a method should be specified in which it is possible to largely dispense with adding a chemical binder or thermoplastic binder fibers to the pulp suspension. And particularly for the case in which artificially produced fibers are used for wet-laid nonwovens, particularly in high-temperature applications.

The objective is achieved in accordance with the independent claims. Particularly preferred and advantageous embodiments of the invention are set forth in the dependent claims.

For the purposes of the invention, "fibrous web" refers to a scrim or tangle of fibers of a defined length manufactured from a pulp suspension, such as endless fibers (filaments), or from cut yarns. The fibrous web initially has such a low strength that it is not viable.

A nonwoven fabric or nonwoven web in the sense of the invention is a structure of fibers which in some way have been joined together to form a nonwoven fabric (i.e. a fibrous layer or fibrous web) and for example have been interconnected in some way. For the purposes of the present invention, this refers particularly to a nonwoven fabric that has been wet-laid, i.e. hydraulically (also: hydrodynamically) formed. In other words, a nonwoven fabric is a fibrous web that has been consolidated, and in particular has been finally consolidated. In other words, the fibrous web is a precursor of the fully consolidated nonwoven web that is ultimately produced. Such a nonwoven fabric is deemed to be finally consolidated when as a result of consolidation, it has such a high strength that it is substantially suitable for the intended use, for example for being further processed into corresponding products such as hygiene articles. "Hydraulic pre-consolidation" refers to consolidation that does not yet convert the fibrous web into a nonwoven fabric, because the required degree of consolidation is not achieved. For the purposes of the present invention, (final) consolidation may also be a combination of a (also multi-stage) hydroentanglement—i.e. a hydraulic consolidation process—and an additional impregnation by means of a binder—i.e. a chemical consolidation process. After the nonwoven web has been impregnated with the binder that has been applied to it in a binder section, the nonwoven web may be dried. Optionally, a subsequent mechanical consolidation, for example by means of a needle machine, may further increase the strength of the nonwoven web.

Nonwoven fabrics for purposes of the invention do not include fibrous structures manufactured by interlacing and intertwining yarns such as those used in weaving, knitting, warp-knitting, lacemaking, braiding and the manufacture of tufted products. In addition, foils and papers are not nonwoven fabrics.

The term "hydroentanglement" or "water jet needling" refers to a hydraulic consolidation method for producing a strong bond between the fibers of a nonwoven fabric. In this case, the fibers are entangled and thus the nonwoven fabric is compacted and consolidated through a swirling action, for example as a result of focused high pressure water jets acting on the fibrous web.

For the purposes of the invention, "pulp suspension" refers to a mixture of a liquid—such as water—and fibers.

Forming screens and/or support screens are usually designed as endless self-contained loops, e.g. circulating on rollers. They may be set up in such a way that the fibrous web may be water-jet-needled onto them. This means that the corresponding forming screen and/or support screen is permeable to water so that the water jets may pass through it.

For the purposes of the invention, a former, such as an inclined wire former, is associated with a forming screen that extends at an angle to the horizontal at least in part—for example along a first section. In this section, at least one headbox is arranged in such a way that it applies the pulp suspension on top of the forming screen. "On top" means that the pulp suspension is applied to the upper side of the forming screen. This is the side facing away from the rollers on which it circulates and facing toward the headbox outlet. On the bottom, i.e. in the vicinity of the underside of the forming screen, at least one dewatering element may be arranged for dewatering the newly applied pulp suspension. The headbox may in turn be associated with the inclined wire former. The inclined wire former is usually arranged such that the first section rises toward the deposited fibrous web, when viewed at an angle relative to a horizontal plane.

When reference is made in the present invention to the pulp suspension being substantially free of binders, it is meant that the suspension contains less than 10% by volume of binders, preferably less than 5% by volume and particularly preferably no binders. Among binders are agents that achieve bonding of the fibers to one another, so that, for example, a firm bond results between the fibers. The term "binder" covers chemical binders which are, for example, applied in liquid form to the fibrous web or are added to the pulp suspension. These binders bond the fibers together positively, by adhesion.

"Decomposition temperature" refers to the temperature at which the material of the fibers decomposes chemically or thermally. The decomposition temperature is characteristic, for example, for materials that do not melt, such as thermosetting plastics. "Melting point" refers to the temperature at which the material, for example the fiber, passes from the solid state into the molten state.

"Modulus of elasticity" signifies a material parameter used in materials technology to describe the relationship between stress and strain when a solid body is deformed under linearly elastic behavior. The term "flexural rigidity" refers to the product of the modulus of elasticity with the corresponding geometrical moment of inertia. Thus, with the same geometrical moment of inertia, one material or a fiber produced therefrom is more flexurally rigid than the other if it has a higher modulus of elasticity. A fiber is flexible in the sense of the invention if it or its material has a modulus of elasticity that is below 10 GPa and rigid when the modulus of elasticity is at least 10 GPa.

"Fire-resistant" refers to a material which, in the event of fire, retains its function—ie does not melt or decompose—over a certain period of time and is, for example, flame-resistant.

The term "binder fibers" means fibers that have a lower modulus of elasticity than the fibers of the pulp suspension according to the invention and thus are more flexible than the fibers of the invention—at the same geometrical moment of inertia. Mixing the binder fibers into the flexurally rigid fibers according to the invention enables the rigid fibers to solidify as a result of entangling with these fibers, which thus form a matrix. Thus, the binder fibers indirectly allow the rigid fibers to better consolidate with each other. The binder fibers may—but need not necessarily—be melted like the conventional fibers known from the thermal consolidation process, and thus be made of thermoplastics. In this case, these binder fibers may be fused together by thermal activation, such as thermofusion or thermal calendering. For this purpose, the material of these binder fibers may have a melting point below 300° C.

In particular for high-temperature applications of at least 300° C., the comparatively rigid fibers as well as the binder fibers should be made of a material having a decomposition or melting point of at least 300° C. The statement "at least 300° C." means above 300° C., and therefore includes higher temperatures, such as above 350° C. or above 500° C. In such fields of application, the advantages of the invention are particularly satisfactory. This is where existing chemical and thermal consolidation processes fail. That is because above this temperature(s), both the chemical binder and the thermal binder fibers dissolve, and as a result, the rigid fibers lose their bonding and the nonwoven fabric dissolves. With respect to high-temperature applications, this means that the nonwovens manufactured according to the invention, or final products into which the nonwovens are processed are operated or used in such an ambient temperature of at least 300° C., preferably above 350° C., and particularly preferably above 500° C. In contrast, low-temperature applications are below 300° C.

Such nonwovens may preferably be made of glass, metal, mineral, ceramic or carbon fibers. These are known as technical nonwovens. Such fibers may also be plastic fibers such as aramid fibers, but also mineral fibers such as basalt fibers. Metallic fibers that may be considered include for example steel, stainless steel or titanium fibers. These mentioned materials frequently have a modulus of elasticity of at least 10 GPa. In this case they are comparatively hard, brittle and flexurally rigid, and may have difficulty entangling and intertwining with one another. Therefore, it is particularly advantageous if in addition to these fibers, binder fibers are used that are less rigid.

Irrespective of the illustrated embodiments, both the comparatively flexible as well as the relatively beige fibers are preferably designed to be fire-resistant.

If, for example, the nonwoven web is hydraulically consolidated on the forming screen—and preferably finally consolidated there—then the total length of the apparatus for manufacturing a nonwoven web, in the direction of travel of the nonwoven web that is being manufactured, may be considerably reduced. However, the hydraulic consolidation could potentially be designed as a multi-stage process. For example, pre-consolidation by hydroentanglement could first take place on the forming screen, and the final consolidation could take place in a further process step outside the forming screen.

In principle, it would be conceivable to produce a nonwoven web that is wholly free of chemical binders as well as (thermal) binder fibers. Nevertheless, applications are conceivable in which, following hydraulic consolidation, the nonwoven web is also thermally or chemically consolidated by being soaked, for example, with a binder. As a result, the strength of such a web is further increased. Nonwovens produced in this way may be usefully employed in low-temperature applications below 300° C.

It would also be conceivable to additionally structure the nonwoven web after it has been consolidated—preferably by means of water jets. This may also be done by means of appropriate structuring devices, e.g. by means of water jets. In this case, the strength of such a nonwoven web be improved, and it may also be given a predetermined structure.

In order to dry the consolidated nonwoven web quickly and effectively, it may be dewatered mechanically, for example by means of a press or vacuum suction, or thermally by means of a dryer (for example what is termed a through-flow dryer in the case of through-flow drying technology).

The present invention further relates to the use of an apparatus for manufacturing a wet-laid nonwoven web that has been set up according to the invention.

The present invention also relates to the product manufactured directly by means of the method according to the invention, that is to say the nonwoven fabric itself.

The present invention also relates to a use of the apparatus according to the invention in accordance with the steps of the method according to the invention.

Finally, the invention also relates to a method for converting an apparatus for manufacturing a wet-laid nonwoven web, as set forth in the claims. As a result, existing apparatuses that are specialized for thermal or chemical binders may be quickly, easily and cost-effectively converted to hydraulic consolidation. The overall length of such a retrofitted apparatus may be reduced, even if the previous binder section is removed.

BRIEF DESCRIPTION OF THE SEVERAL VIEWS OF THE DRAWING

The invention will be explained in greater detail below with reference to the drawings, without limiting its generality. The drawings show the following.

DESCRIPTION OF THE INVENTION

Figure 2:
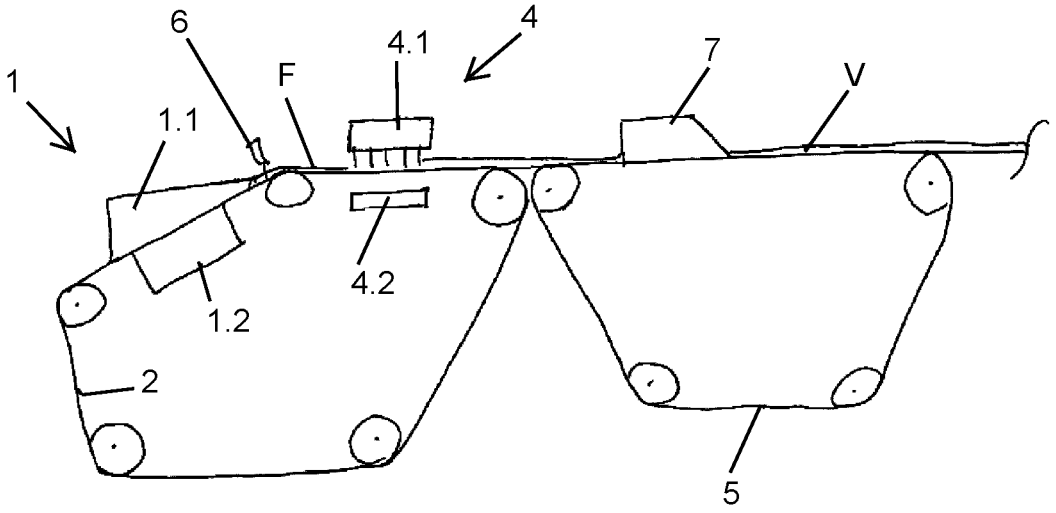
FIG. 2 a highly schematic representation of an apparatus according to the invention in a side view according to another embodiment.

FIG. 2 shows, schematically and therefore not to scale, a side view of an apparatus according to the invention for wet-laying a nonwoven web. The apparatus comprises a former, which in this case is designed as inclined wire former 1. An infinite forming screen 2, which here moves on rollers, is associated with the former. This fabric revolves relative to the stationary inclined wire former 1. A headbox 1.1 is arranged above the forming screen 2. The latter is associated with the inclined wire former 1. A pulp suspension may be fed to the headbox 1.1, and may be applied to the forming screen 2, more precisely on the upper side thereof, via an outlet of the headbox 1.1. The pulp suspension usually has a water-fiber mixture. The forming screen 2 is designed so as to let the water through. Below the forming screen 2, on the side facing the headbox 1.1, a dewatering box 1.2 is arranged for discharging the water from the pulp suspension. The dewatering box 1.2 is associated with the inclined wire former 1.

In normal operation of the apparatus, the pulp suspension passes through the outlet of the headbox 1.1 to the forming screen 2 that is moving past on the rollers relative to the headbox 1.1 and dewatering box 1.2. The water flows through the forming screen 2 into the dewatering box 1.2. The fibers from the pulp suspension continue to hang onto the forming screen 2 and are transported along with it. In this way, a corresponding fibrous web F is continuously stored or formed on the forming screen 2.

In a first section, the forming screen 2 is—viewed in its own direction of travel or in the direction of travel of the fibrous web F—inclined upward from the horizontal. In this first stretch, the inclined wire former 1 is arranged, i.e. the fibrous web F is formed in this section. The first section is bounded by the upper rollers, which come immediately after one another in the direction of travel of the support screen 2. At least two such upper rollers are furnished for this purpose. In the illustration shown, the forming screen 2, which circulates in the clockwise direction, thus rises in the first section, from bottom left to top right.

The fibrous web F is still fed past after being formed on the forming screen 2, to be hydraulically consolidated under the consolidation device 4. A plurality of water jet nozzles 4.1, here situated above the forming screen 2, and an outlet 4.2 for water, situated below the forming screen 2, are associated with the consolidation device. In this case, as shown, the forming screen 2 circulates horizontally, or at least partially substantially parallel to the horizontal plane in the region in which the water-jet nozzles 4.1 and the outlet 4.2 are arranged. According to this embodiment, the fibrous web F undergoes final consolidation on the forming screen 2, to form the nonwoven web V.

The former thus constitutes the forming section of the apparatus. In the direction of travel of the nonwoven web V being manufactured, in this case, a binding section of the apparatus directly abuts the forming section. This section comprises an application apparatus 7, which is arranged above a transport screen 5 that extends horizontally or at least partially substantially parallel to the horizontal plane. The nonwoven web V, having undergone final hydraulic consolidation, may be impregnated with a chemical binder by means of the application apparatus 7. In the direction of travel of the nonwoven web V being manufactured (from left to right in the view of FIG. 2), for example a thermal drying device may be attached directly to the binder section, in order to dry the nonwoven web V (not shown) that has been provided with binder.

Figure 1:
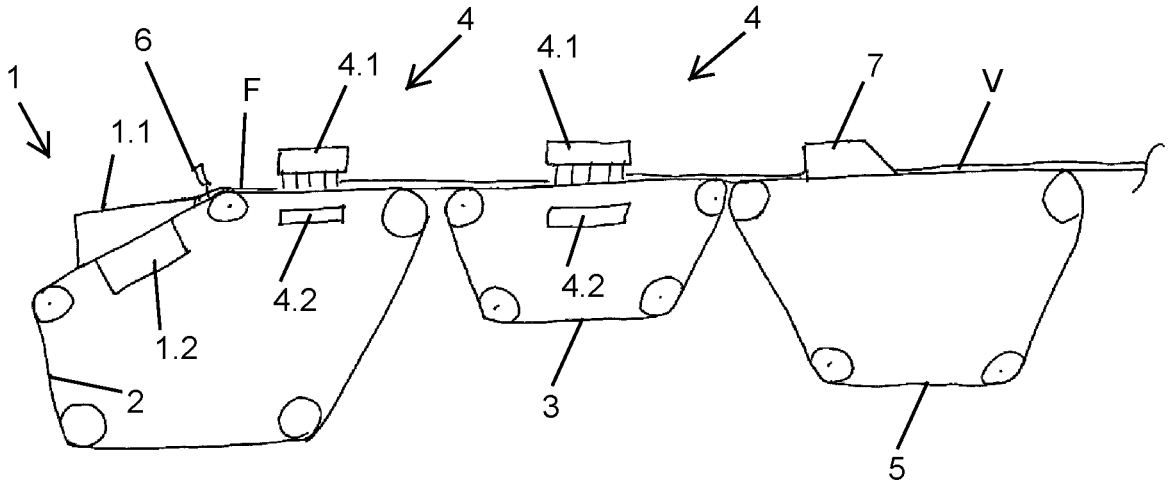
FIG. 1 a highly schematic representation of an apparatus according to the invention in a side view according to a first embodiment.

FIG. 1 shows a refinement of the embodiment from FIG. 2. There, substantially the same components are shown and correspondingly designated as in FIG. 2. In addition, however, an additional consolidation device 4 is arranged. Viewed in the direction of travel of the nonwoven web V being manufactured, this device follows immediately after the forming screen 2. The additional consolidation device 4 likewise comprises a plurality of water jet nozzles 4.1, which here are arranged above a support screen 3 and an outlet 4.2 for water, which is arranged below a support screen 3. Thus, viewed in the direction of travel of the nonwoven web being manufactured, the additional consolidation device 4 comes after the forming section and upstream of the optional binder section (respectively immediately before and after).

As shown in the two drawings, in the direction of travel of the nonwoven web being manufactured, the (first) hydraulic consolidation device 4 is associated with a pre-consolidation device 6. In principle, this may be set up analogously to the hydraulic consolidation device 4, but may be operated at a lower pressure than the consolidation device 4, which is for example only 5 to 25 bar. The respective consolidation device 4, in contrast, may be operated at a pressure of 15 to 400 bar.

As shown in the drawings, the fibrous web F is consolidated from one side, in this case the upper side, namely the side facing away from the forming screen 2 or the support screen 3. In principle, it would also be conceivable to additionally strengthen the fibrous web F from its lower side. To that end, according to FIG. 1, in the direction of travel of the nonwoven web V being manufactured, the additional consolidation device 4 could directly be followed by a further consolidation device, not shown. In the aforementioned direction of travel, this device could be placed upstream of the binder section shown in the drawings. In the embodiment of FIG. 2, in the same direction of travel, the device would be directly downstream of the forming screen 2 or forming section. Such a consolidation device could comprise a cylinder that at least partially wraps around the fibrous web F to (finally) consolidate the web. In turn, a plurality of water jet nozzles are then directed onto the cylinder, in order to apply water jets from below onto the fibrous web that has been partially fed around the cylinder.

Irrespective of the illustrated embodiment, the rigid fibers according to the invention are mixed into the pulp suspension. In this case, the pulp suspension may be substantially free of any added (chemical) binder. Preferably, binder fibers may also be added to these fibers—either already in the pulp suspension, or shortly before the (first) hydraulic consolidation. As stated initially, the binder fibers may be designed to be comparatively flexible compared to the fibers according to the invention, so that their entanglement provides a higher overall strength for the nonwoven web during hydraulic consolidation.

In principle, and irrespective of the illustrated embodiment, the binder section could be dispensed with. Thus, a conventional apparatus for manufacturing such a nonwoven web usually comprises the components shown in FIGS. 1 and 2, but does not comprise any (pre-)consolidation devices 4 and 6. To convert such a conventional apparatus in accordance with the invention, the aforementioned (pre-) consolidation devices 4 and 6 are now mounted at the aforementioned locations, and then the binder section is preferably removed. Alternatively, instead of this, a conventional transport screen may for example be provided. Thus, conventional apparatuses that provide thermal or chemical bonding of the fibers to manufacture a nonwoven web without hydraulic consolidation may be provided. Such a conventional apparatus may be quickly, easily and cost-effectively converted to an apparatus according to the invention.

LIST OF REFERENCE SIGNS

1 Inclined wire former
1.1 Headbox
1.2 Dewatering box
2 Forming screen
3 Support screen
4 Consolidation device
4.1 Water jet nozzles
4.2 Outlet
5 Transport screen
6 Pre-consolidation device
7 Applicator
F Fibrous web
V Nonwovenweb

The invention claimed is:

1. A method of manufacturing a wet-laid nonwoven web, the method comprising the following steps:

providing a pulp suspension of industrially produced, inorganic fibers or fibers of synthetically produced polymers, the pulp suspension being substantially free of binders;

feeding the pulp suspension onto a forming screen for depositing a fibrous web thereon;

consolidating the fibrous web by hydroentanglement of the fibrous web to produce the nonwoven web;

providing the pulp suspension with binder fibers or feeding binder fibers into the fibrous web before or during the consolidating step; and the fibers having a decomposition point or melting point above 300° C., the material of the fibers have a modulus of elasticity of at least 10 GPa, and the binder fibers have a modulus of elasticity that is lower than 10 GPa.

2. The method according to claim 1, wherein the material of the fibers is selected from the group consisting of glass, metal, mineral, ceramic, and carbon.

3. The method according to claim 1, wherein the fibers have a mean length of 2 to 40 mm.

4. The method according to claim 1, wherein the binder fibers are plastic fibers selected from the group consisting of thermoplastic fibers and fire-resistant fibers, and/or the binder fibers are selected such that their decomposition or melting point is at least 300° C.

5. The method according to claim 1, which comprises consolidating the fibrous web by a final hydraulic consolidation at the forming screen to form the nonwoven web in substantially finished form.

6. The method according to claim 1, wherein the consolidating step comprises performing a hydraulic pre-consolidation by water jet needling at the forming screen, and effecting a final consolidation in an additional process step outside the forming screen.

7. The method according to claim 1, wherein the consolidating step comprises hydraulically consolidating by water jetting and subsequently chemically consolidating the nonwoven web.

8. The method according to claim 7, wherein the step of chemically consolidating the nonwoven web comprises impregnating with a binder.

9. The method according to claim 1, which comprises mechanically dewatering the nonwoven web by way of a press, or dewatering by subjecting the nonwoven web to vacuum dewatering, or thermally dewatering by way of a dryer.

10. An apparatus for manufacturing a wet-laid nonwoven web, the apparatus comprising:

an inclined wire former having a forming screen for producing a fibrous web by depositing a pulp suspension on the forming screen; and a first hydraulic consolidation device associated with said forming screen a configured for hydraulically consolidating the fibrous web into a nonwoven web; and the apparatus being configured carry out the method according to claim 1.

11. The apparatus according to claim 10, further comprising a support screen arranged downstream of said forming screen in a direction of travel of the nonwoven web being manufactured, and a second hydraulic consolidation device associated with said support screen in order to finally consolidate the fibrous web after having been pre-consolidated by said first hydraulic consolidation device.

12. The non-woven fabric according to claim 10, formed of a nonwoven web manufactured according to claim 1.

13. A method for converting an apparatus for manufacturing a wet-laid nonwoven web, the apparatus having:

a forming section with a former and at least one forming screen associated therewith; and a binder section with a binder application unit for impregnating the nonwoven web with a binder;

the method comprising the following steps:

mounting a consolidation device, having at least one water jet nozzle, for hydraulically consolidating a fibrous web to a nonwoven web in a vicinity of the forming screen; and deactivating or removing the binder section from the apparatus.

14. A nonwoven web, comprising:

a water jet-consolidated nonwoven web made from a wet-laid fibrous web laid from a pulp suspension substantially free of binders, the wet-laid fibrous web containing industrially produced inorganic fibers or fibers made from synthetically produced polymers;

the nonwoven web having the characteristics of having had binder fibers applied thereto before or during the water jet-consolidation; and the fibers have a decomposition or melting point of above 300° C., the material of the fibers has a modulus of elasticity of at least 10 GPa, and the binder fibers have a modulus of elasticity that is lower than 10 GPa.

15. A non-woven fabric for high-temperature application, the fabric comprising:

a wet-laid and hydroentangled nonwoven fabric formed of industrially produced inorganic fibers or fibers of synthetically produced polymers and being free of binders, said fibers having a decomposition or melting point of above 300° C.;

the nonwoven fabric having the characteristics of having had binder fibers applied thereto before or during the water jet-consolidation; and said fabric being configured for use in high temperature applications of at least 300° C., the material of the fibers has a modulus of elasticity of at least 10 GPa, and the binder fibers have a modulus of elasticity that is lower than 10 GPa.

* * * * *